US005407202A

United States Patent [19]

Igarashi

[11] Patent Number: 5,407,202

[45] Date of Patent: Apr. 18, 1995

[54] GOLF CLUB WITH FACEPLATE OF TITANIUM OR OTHER HIGH STRENGTH, LIGHTWEIGHT METAL MATERIALS

[76] Inventor: Lawrence Y. Igarashi, 30231 Tomas Rd., Rancho Santa Margarita, Calif. 92688

[21] Appl. No.: 970,708

[22] Filed: Nov. 3, 1992

[51] Int. Cl.[6] ..... A63B 53/04

[52] U.S. Cl. ..... 273/169; 273/167 F; 273/167 H; 273/173

[58] Field of Search ..... 273/77 R, 77 A, 164.1, 273/167 R, 167 A, 167 E, 167 F, 167 G, 167 H, 167 J, 167 K, 170, 171, 172, 173, 174, 175, 169, 193 R, 194 R

[56] References Cited

U.S. PATENT DOCUMENTS

| | | | |
|---|---|---|---|
| 2,846,228 | 8/1958 | Reach | 273/169 |
| 3,814,437 | 6/1974 | Winquist | 273/167 H X |
| 4,027,885 | 6/1977 | Rogers | 273/173 X |
| 4,214,754 | 7/1980 | Zebelean | 273/167 H |
| 4,252,262 | 2/1981 | Igarashi | 228/174 |
| 4,398,965 | 8/1983 | Campau | 273/78 X |
| 4,429,879 | 2/1984 | Schmidt | 273/167 H |
| 4,432,549 | 2/1984 | Zebelean | 273/167 H |
| 4,489,945 | 12/1984 | Kobayashi | 273/167 H |
| 4,511,145 | 4/1985 | Schmidt | 273/167 H |
| 4,618,149 | 10/1986 | Maxel | 273/79 |
| 4,690,408 | 9/1987 | Kobayashi | 273/172 X |
| 4,749,197 | 6/1988 | Orlowski | 273/173 |
| 4,754,969 | 7/1988 | Kobayashi | 273/167 H X |
| 4,768,787 | 9/1988 | Shira | 273/173 X |
| 4,792,139 | 12/1988 | Nagasaki | 273/167 H |
| 4,792,140 | 12/1988 | Yamaguchi et al. | 273/173 |
| 4,802,672 | 2/1989 | Long | 273/167 H X |
| 4,804,188 | 2/1989 | McKee | 273/173 X |
| 4,824,110 | 4/1989 | Kobayashi | 273/169 X |
| 4,867,458 | 9/1989 | Sumikawa | 273/167 H X |
| 5,000,454 | 3/1991 | Soda | 273/173 X |
| 5,024,437 | 6/1991 | Anderson | 273/78 |
| 5,028,049 | 7/1991 | McKeighen | 273/167 H |
| 5,056,705 | 10/1991 | Wakita et al. | 228/176 |
| 5,090,702 | 2/1992 | Viste | 273/167 H |
| 5,094,383 | 3/1992 | Anderson | 273/167 H X |
| 5,176,384 | 1/1993 | Sata | 273/167 R X |

FOREIGN PATENT DOCUMENTS

| | | | |
|---|---|---|---|
| 211781 | 12/1957 | Australia | 273/167 F |
| 4-04288173 | 10/1992 | Japan | 273/167 J |
| 379032 | 8/1932 | United Kingdom | 273/78 |
| 442557 | 2/1936 | United Kingdom | 273/80 R |

OTHER PUBLICATIONS

"The New Iron Catalog, 1992".

*Primary Examiner*—Sebastiano Passaniti
*Attorney, Agent, or Firm*—Roberts and Quiogue

[57] ABSTRACT

A golf club having a metal club head with a faceplate insert made of a high strength, lightweight metal material such as titanium. The weight savings resulting from the lighter, stronger titanium permits mass to be distributed to improve the moment of inertia of the club head. Both iron and metal wood clubs having the titanium faceplate insert are described.

31 Claims, 3 Drawing Sheets

FIG. 6
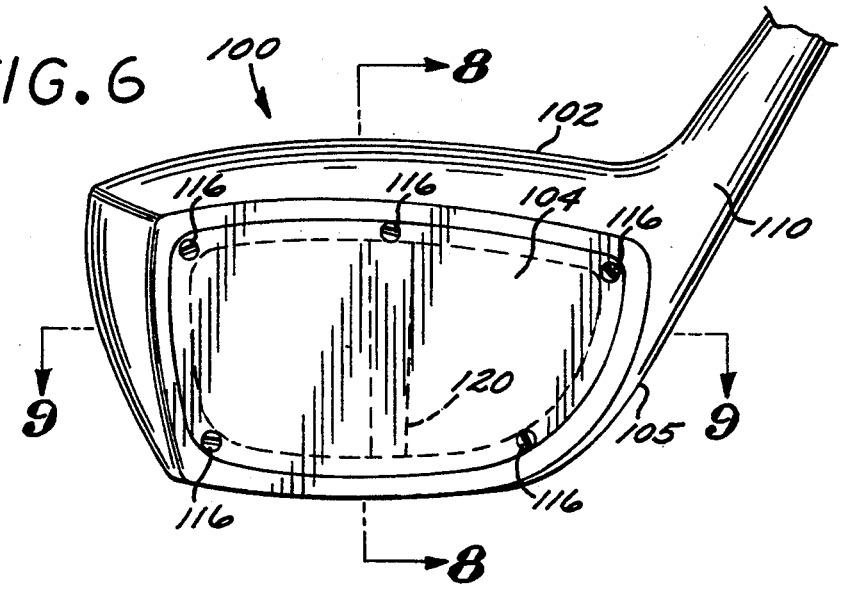
FIG. 7
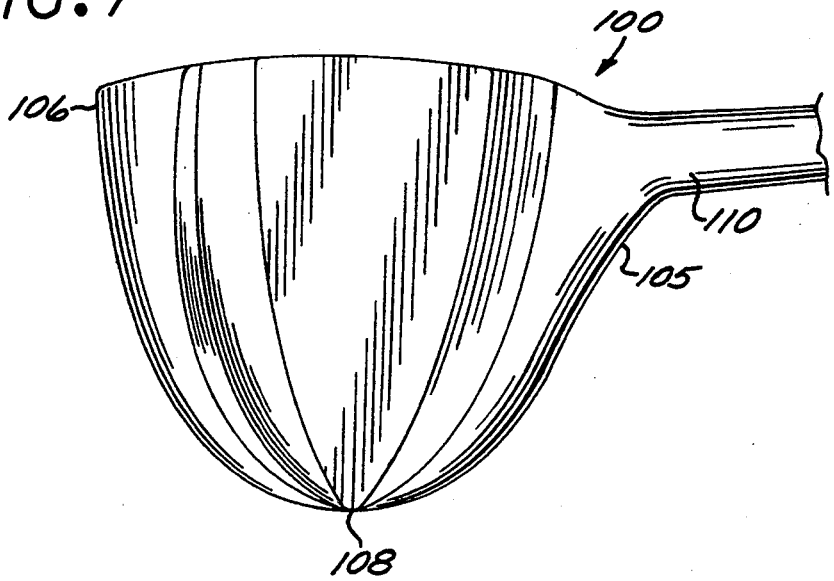
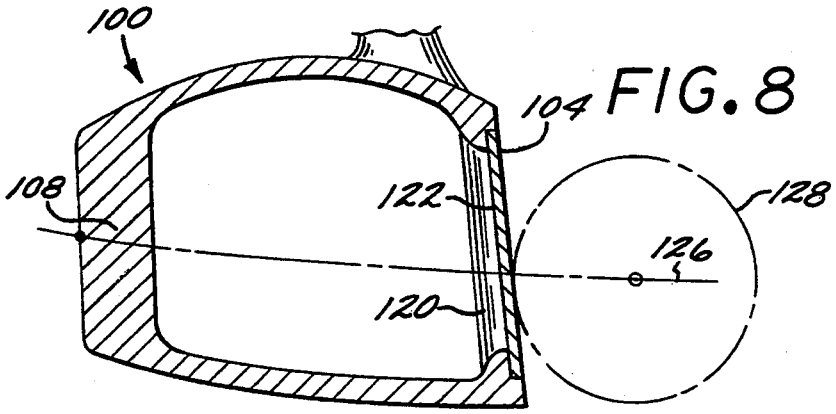
FIG. 8

GOLF CLUB WITH FACEPLATE OF TITANIUM OR OTHER HIGH STRENGTH, LIGHTWEIGHT METAL MATERIALS

BACKGROUND OF THE INVENTION

The present invention relates to golf clubs with an improved weight distribution and moment of inertia, and more particularly to golf clubs fabricated of a cast metal such as stainless steel with face inserts of titanium or other high strength, lightweight metal materials.

With the advent of metal "woods" in the golf club industry, considerable attention has been paid to the effects of the moment of inertia on golf club performance. Metal woods are typically fabricated by investment casting techniques, usually from stainless steel or like metals, although it is known to employ all titanium-alloy club heads. The disadvantage of stainless steel club heads is the relatively high specific weight of stainless steel, and the relatively low strength characteristic of the material. These characteristics require a relatively thick and heavy faceplate section of the club head, thereby placing relatively more weight and the faceplate, leaving less weight to be distributed around the club periphery to improve the weight distribution and moment of inertia. Club heads made entirely from titanium alloy are expensive, and it is more difficult to fabricate titanium alloy heads than to fabricate stainless steel or aluminum heads.

It is also known to use a metal club head with a forged metal insert as the faceplate, with the faceplate being welded to the club head material. This requires that the material of the club head and the material of the faceplate be compatible to be welded together.

It is therefore an object of this invention to provide an improved golf club having a hollow body fabricated of a first metal such as stainless steel, and a faceplate insert of titanium being secured to the body by adhesive and/or screw fasteners, thereby reducing the weight of the faceplate and permitting redistribution of the body weight to improve the moment of inertia.

A further object is to provide a golf club head employing a titanium faceplate insert with a bridge element supporting the faceplate.

SUMMARY OF THE INVENTION

In accordance with this invention, a golf club is provided having a metal faceplate insert secured without welding to a club head body. The faceplace metal is a titanium alloy, or other high strength, lightweight metal material. The golf club includes a club head body fabricated of a first metal, and defining a faceplate receiving area to which the club head faceplate may be secured. The faceplate is fabricated of a metal comprising titanium, and is adapted to be mounted to the club head body at the receiving area. The club head further includes means for securing the faceplate to the body at the receiving area without welding.

In a preferred golf driver embodiment, the first metal is stainless steel or aluminum, and the faceplate is titanium alloy.

In one embodiment, the receiving area comprises a recessed peripheral shoulder fabricated in the outline of the faceplate so that the periphery of the faceplate abuts against the shoulder when the faceplate is mounted at said receiving region. The shoulder provides support for the faceplate against the force of impact of a golf ball when struck by the head. The securing means comprises, for example, a plurality of fastener members, e.g., threaded or rivet fasteners, which extend from the faceplate into the peripheral shoulder.

In accordance with a further aspect of the invention, the golf club head of claim 1 wherein the club head body further comprises one or more support struts which extend across the receiving region, the faceplate abutting against the support struts when mounted to the club head body at the receiving area.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a front view of a golf driver head embodying the invention.

FIG. 7 is a bottom view of the driver head of FIG. 5.

FIG. 8 is a cross-sectional view of the driver head of FIG. 5, taken along line 8—8 of FIG. 6.

DETAILED DESCRIPTION OF THE PREFERRED EMBODIMENT

Figure 1:
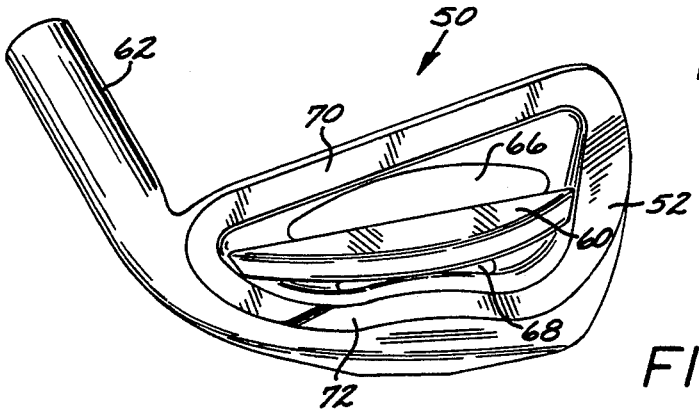
FIG. 1 is a rear view taken of a golf iron club head embodying the present invention.

A golf iron club head 50 embodying this invention is illustrated in FIGS. 1-5. The iron head 50 includes a head body, indicated generally as element 52, and a faceplate 54, which is secured to the body 52 at a faceplate receiving area while the club head is known as an "iron," it need not and typically is not made of iron. In this exemplary embodiment, the head body 52 is made of a first metal such as stainless steel or aluminum. The faceplate is fabricated from a metal or metal alloy which is a high strength metal which is lighter in specific weight or stronger than the first metal. An exemplary metal for the faceplate a titanium alloy. A preferred titanium alloy is TI 6/4, i.e., 90% titanium, 6% vanadium and 4% aluminum. In this exemplary embodiment, the faceplate 54 has a thickness of ⅛ inches (3 mm). Alternatively, the faceplate 54 can be made of a ceramic alloy or boron, also high strength, lightweight materials.

A characteristic of this titanium alloy is that it has about one half the specific weight, but twice the strength, of stainless steel. By using a faceplate of titanium or titanium alloy, a faceplate can be used which weighs significantly less than a stainless steel or aluminum plate material. In fact, a titanium alloy faceplate can be used which is only one half the thickness of conventional stainless steel faceplates, and therefore weighs only one quarter as much as such stainless steel faceplates. This weight savings means that additional mass can be added to the head body to improve the weight distribution and moment of inertia of the head, without making the club head any heavier than conventional heads. Additional mass is added in this embodiment in the form of a strut element 60.

The portion of the strut 60 extending behind the faceplate has a curved rear peripheral surface. The strut 60 has a substantial thickness, in this embodiment ⅛-5/16 inches. As a result, the center of gravity of the club head is moved well behind the faceplate 54.

Figure 3:
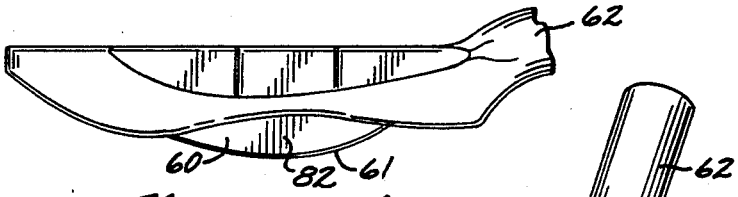
FIG. 3 it a top view of the golf iron head of FIG. 1.

The club head body 52 may be fabricated as a one piece element by well known investment casting techniques. The body 52 includes a club hosel 62, a heel area 64, and a toe area 66. The strut element 60 extends generally laterally behind the plate receiving area from the heel area 64 to the toe area 66. The body 52 includes open areas 66 and 68, thereby permitting more body mass to be distributed to the periphery to improve the moment of inertia of the club. The strut 60 adds mass generally at the rear area indicated generally as area 82 (FIG. 3). Additional mass can be added at the heel and toe indicated as areas 84 and 82 by redistributing some of the weight savings obtained by use of a titanium faceplate. This results in three-dimensional club head weighting at the heel, toe and rear areas of the club head, thereby increasing the moment of inertia of the club head.

The faceplate 54 can be secured by screws 74 which extend into recessed shoulder areas defined by the head body 52. Alternatively, or in addition to screw or rivet fasteners, the faceplate 5 can be secured to the body 52 by adhesives, including epoxy, or by a press-fit of the faceplate into the faceplate receiving area, wherein the edges of the faceplate are forced into an interference fit with the edges of the body defining the perimeter of the faceplate receiving area. The shoulder areas include the surfaces 76 and 78 of FIG. 4, and are recessed so that the external surface of plate 54 fits flush with the frontal surface 80 of the body 52. The strut 60 provides reinforcement to the faceplate against the impact force resulting from the club head striking the golf ball.

Figure 2:
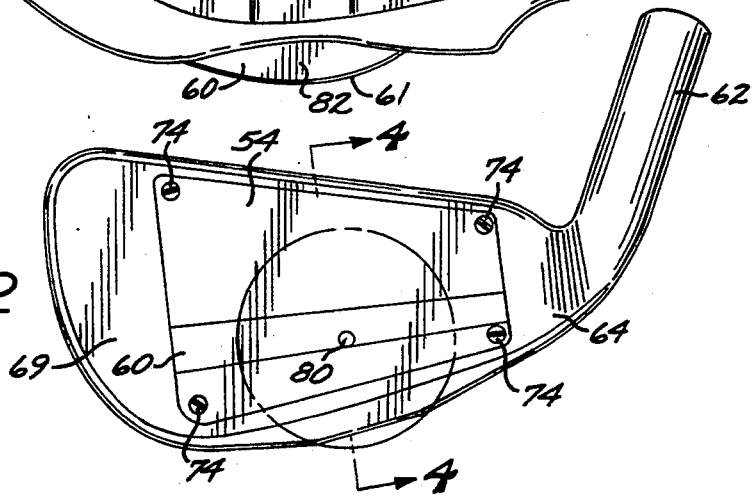
FIG. 2 is a front view of the golf iron head of FIG. 1.
Figure 4:
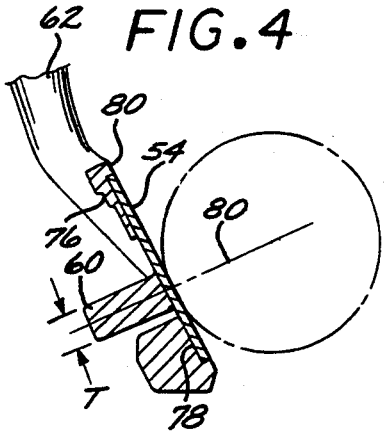
FIG. 4 is a cross-sectional view of the golf iron head, taken along line 4—4 of FIG. 2.
Figure 5:
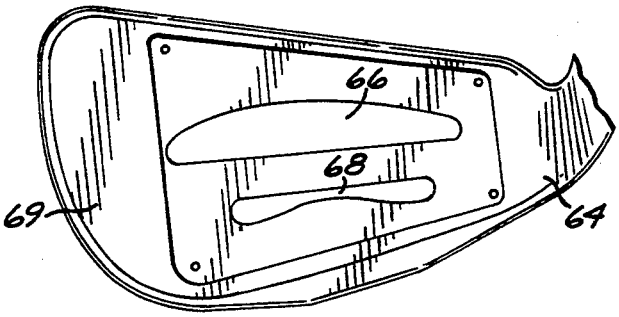
FIG. 5 is a front view of the golf iron head of FIG. 1 taken without the faceplate.

It is a further feature of this invention to position club head mass directly behind, and as far as possible from, the impact zone of the golf ball 82 with the faceplate 54. This is accomplished in this embodiment by the positioning of the strut 60 behind the plate 54, centered on the nominal center 80 of the impact zone, as shown in FIGS. 2 and 4.

FIGS. 6–10 illustrate embodiments of a golf driver club embodying this invention. The club head 100 illustrated in FIGS. 6–9 is of the type known as a metal wood. The head comprises a hollow metal body 102, fabricated in this example from a hollow stainless steel or aluminum investment casting. In order to obtain a desired moment of inertia, the body 102 has a generally thin skin or wall, except that additional mass is placed at the heel 105, toe 106 and rear 108 areas of the club head to provide a three dimensional weight distribution as described in U.S. Pat. No. 5,058,895; see particularly FIGS. 1–11 and discussion thereof. A typical thickness of the body at areas away from the thickened areas is on the order of 0.30 to 0.70 inches depending on material. The body 102 further includes a shaft hosel 110, in the conventional manner.

As with the embodiment of FIGS. 1–5, the club head 100 further includes a separate faceplate 104, fabricated of TI 6/4 titanium alloy having a thickness of ⅛ inches (3 mm). Alternatively, the faceplate can be fabricated of a ceramic alloy or boron material, other high strength lightweight materials.

Figure 9:
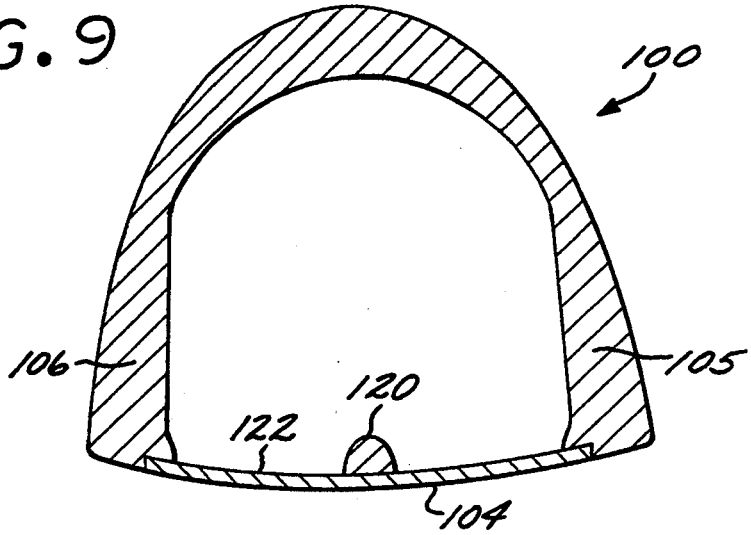
FIG. 9 is a cross-sectional view of the driver head of FIG. 6 taken along line 9—9.

FIG. 9 shows the head 100 with the faceplate removed. The faceplate receiving region shown generally as region 112 includes a recessed peripheral shoulder 114 which is disposed to extend behind the periphery of the faceplate 104 when it is secured in position. In this embodiment, since the body 102 is hollow, the region 112 is open, except for the shoulder 114. The depth of the recess formed by the shoulder 114 is equal to the thickness of the plate 104, so that the plate 104 will fit flush with the front surface of the body 102 when the plate has been installed. The added mass at the heel, toe and rear areas 105, 106 and 108 is also illustrated in FIG. 9.

A plurality of screws 116 can be used to fasten the plate 104 to the body 102. The heads may be ground off and filled with an adhesive including epoxy to improve the appearance and prevent removal of the plate 104. Alternatively, the plate 104 may be secured in position with an adhesive including epoxy with or without the use of screws or rivets, and/or by press-fitting the faceplate 104 into an interference fit with edges of the body defining the periphery of the plate receiving area.

Figure 10:
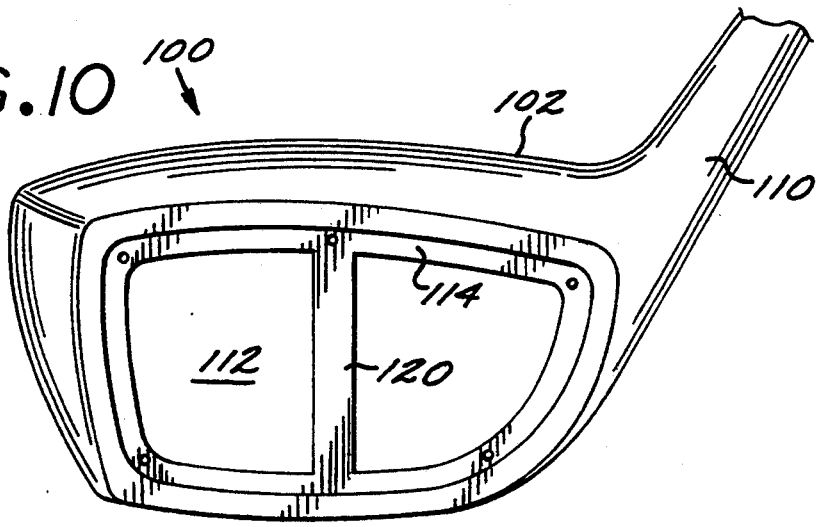
FIG. 10 is a view of the driver head of FIG. 5 taken without the faceplate in position.
Figure 11:
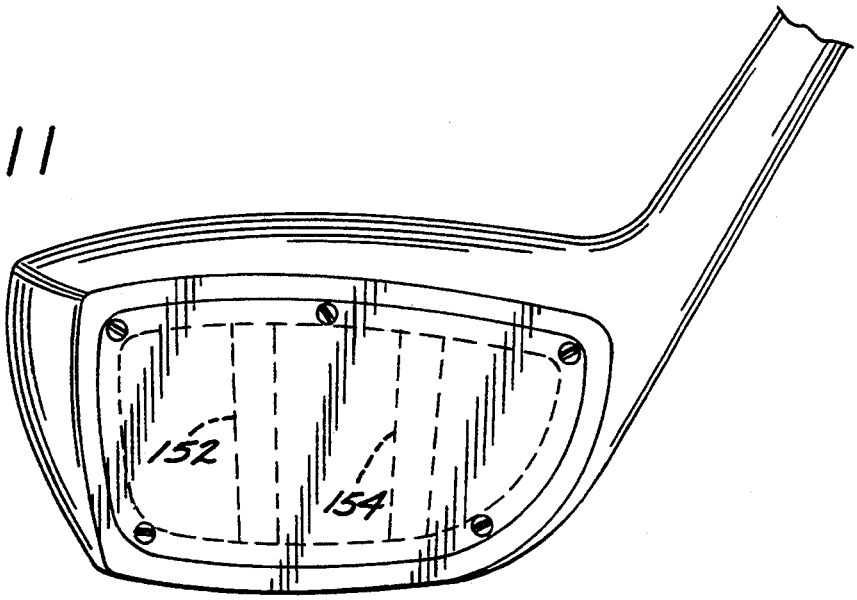
FIG. 11 is a front view of an alternative driver head embodying the invention.

In accordance with another aspect of this invention, the club head body 102 includes one or more vertical struts 120 extending across the plate receiving region 112. The strut 120 provides reinforcement against the impact force when the club strikes the golf ball. A single strut 120 is shown in the embodiment of FIGS. 6–10. FIG. 10 shows an embodiment with two spaced struts 152 and 154 employed to reinforce against impact force.

It is a further object of this invention to locate mass of the club head at the further point possible behind the hitting spot of the club. As with the iron head of FIGS. 1–5, the use of the titanium faceplate 104 substantially reduces the mass necessary for the faceplate in comparison with stainless steel. This in turn permits additional mass to be placed at the rear of the head, and at the heel and toe areas, to provide an improved three-dimensional weight distribution without increasing the weight of the head. The additional mass added at the rear area 108 is illustrated in FIG. 8, with the additional material centered directly behind the center 126 of the nominal impact zone of a golf ball 128 with the faceplate 104.

The advantages of the invention can be illustrated by considering specific examples. The face of a conventional stainless steel metal wood may typically have a thickness of about 2.5 to 3 mm, and weigh on the order of 50 grams, compared with a total head weight of about 205 grams, or about 25% of the total head weight. The face of a conventional aluminum metal wood may typically have a thickness of about 6 mm, and weigh on the order of 45 grams, thereby accounting for about 22% of the 205 gram total head weight. In contrast to these conventional metal woods, a metal wood having a titanium alloy faceplate in accordance with the invention can have a thickness of 3 mm and weigh on the order of 25 grams, thereby accounting for only 12% of the total body weight. Another embodiment may use a faceplate only 2.3 mm thick, having a weight of only 22 grams, or only about 11% of the total body weight. Accordingly, the invention provides a faceplate weight savings of 20 to 30 grams over conventional aluminum or stainless steel club heads, permitting redistribution of this weight savings at the rear area of the club head to move the center of gravity further behind the faceplate than for conventional club heads, and to the heel and toe areas to increase the moment of inertia. In particular, moving the center of gravity further behind the faceplate increases the gear effect, i.e., the club's ability to correct slicing or hooking (see U.S. Pat. No. 5,058,895, at column 2, lines 4–19). It is desirable for wood clubs to create three-dimensional weighting at the club head toe, heel and rear. The redistribution of the weight saving achieved by use of a titanium faceplate may be in accordance with the following: 70% weight saving added at the club head rear, 20% at toe, and 10% heel. An alternate weight saving redistribution is 65% rear, 25% toe and 15% heel.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A golf metal wood club having a faceplate insert, comprising:

a hollow club head body fabricated of a first metal, said body defining a generally open faceplate receiving area to which a club head faceplate may be secured, said body characterized by a thin metal wall over which the body metal mass is distributed to achieve perimeter weighting of said body, said body including regions of increased weight at heel, toe and rear areas thereof;

a club head faceplate fabricated of a second metal material, said faceplate mounted to said club head body at said receiving area; and means for securing said faceplate to said body at said receiving area without welding said faceplate to said body.

2. The golf club head of claim 1 wherein said receiving area comprises a recessed peripheral shoulder fabricated in the outline of said faceplate so that the periphery of said faceplate abuts against said shoulder when said faceplate is mounted to said body at said receiving area, said shoulder providing support for said faceplate against the face of impact of a golf ball when struck by said head.

3. The golf club head of claim 1 wherein said first metal is stainless steel.

4. The golf club head of claim 1 wherein said first metal is aluminum.

5. The golf club head of claim 1 wherein said second metal comprises titanium.

6. The golf club head of claim 5 wherein said second metal is a titanium alloy.

7. The golf club head of claim 1 wherein said second metal material comprises a ceramic alloy.

8. The golf club head of claim 1 wherein said second metal material comprises boron.

9. The golf club head of claim 1 wherein said club head body comprises a support strut extending across said receiving area, said faceplate abutting against said support strut when mounted to said club head body at said receiving area.

10. The golf club head of claim 9 wherein said strut extends generally vertically across said receiving area from the top to the bottom of said region.

11. The golf club head of claim 1 wherein said club head body comprises first and second spaced support struts extending across said receiving area, said faceplate abutting against said support struts when mounted to said club head body at said receiving area.

12. A golf iron having a faceplate insert, comprising:

a club head body fabricated of a first metal, said body defining a faceplate receiving area to which a club head faceplate may be secured, said body further including a reinforcing strut extending laterally behind said receiving area and extending from a club head heel area to a club head toe area;

a club head faceplate fabricated of a high strength second metal material characterized by a lower specific weight than said first metal, said faceplate mounted to said club head body at said receiving area; and means for securing said faceplate to said body at said receiving area without welding said faceplate to said body.

13. The golf iron of claim 12 wherein said strut is centered on the nominal impact zone of the head with a golf ball, said strut including a curved rear surface so as to position mass behind said impact zone so as to position the center of gravity of said head body well behind said faceplate.

14. The golf iron of claim 12 wherein said first metal is stainless steel.

15. The golf iron of claim 12 wherein said second metal material comprises titanium.

16. The golf iron of claim 15 wherein said second metal is a titanium alloy.

17. The golf club head of claim 12 wherein said second metal material comprises a ceramic alloy.

18. The golf club head of claim 12 wherein said second metal material comprises boron.

19. The golf iron of claim 12 wherein said receiving area comprises a recessed peripheral shoulder fabricated in the outline of said faceplate so that the periphery of said faceplate abuts against said shoulder when said faceplate is mounted to said body at said receiving area, said shoulder providing support for said faceplate against the force of impact of a golf ball when struck by said head.

20. The golf iron of claim 12 wherein said securing means comprises a plurality of fastener members which extend from said faceplate into said peripheral shoulder.

21. The golf iron of claim 20 wherein said fastener members comprise threaded screw members.

22. The golf iron of claim 12 wherein said body receiving area comprises generally open areas above and below said strut, wherein the mass of said body is concentrated outside said receiving area.

23. The golf club head of claim 12 further comprising rear area weighting means for providing weight at a rear area of the club head behind a nominal ball impact point on said faceplate.

24. The golf club head of claim 12 further comprising heel and toe area weighting means for providing weight at toe and heel areas of said club head.

25. The golf club head of claim 24 further characterized in that use of said faceplate provides a faceplate weight savings over a faceplate constructed of said first metal, and wherein said rear, heel and toe weighting means redistribute said faceplate weight savings over said rear, heel and toe areas.

26. A golf club having a faceplate insert, comprising:

a club head body fabricated of a first metal, said body defining a faceplate receiving area to which a club head faceplate may be secured;

a club head faceplate fabricated of a high strength second metal characterized by a lower specific weight than said first metal, said faceplate mounted to said club head body at said receiving area;

means for securing said faceplate to said body at said receiving area without welding said faceplate to said body; and wherein said club head body further comprises a support strut which extends across said receiving area, said faceplate abutting against said support strut when mounted to said club head body at said receiving area.

27. The golf club head of claim 26 wherein said strut extends laterally across said receiving region from one side of said region to the other.

28. The golf club head of claim 26 wherein said strut extends generally vertically across said receiving region from the top of said region to the bottom of said region.

29. A golf club having a faceplate insert, comprising:

a club head body fabricated of a first metal, said body defining a faceplate receiving area to which a club head faceplate may be secured;

a club head faceplate fabricated of a high strength second metal characterized by a lower specific weight than said first metal, said faceplate mounted to said club head body at said receiving area;

means for securing said faceplate to said body at said receiving area without welding said faceplate to said body; and rear area weighting means for providing weight at a rear area of the club head behind a nominal ball impact point on said faceplate.

30. A golf club having a faceplate insert, comprising:

a club head body fabricated of a first metal, said body defining a faceplate receiving area to which a club head faceplate may be secured;

a club head faceplate fabricated of a high strength second metal characterized by a lower specific weight than said first metal, said faceplate mounted to said club head body at said receiving area;

means for securing said faceplate to said body at said receiving area without welding said faceplate to said body; and heel and toe area weighting means for providing weight at toe and heel areas of said club head.

31. A golf club having a faceplate insert, comprising:

a club head body fabricated of a first metal, said body defining a faceplate receiving area to which a club head faceplate may be secured;

a club head faceplate fabricated of a high strength second metal characterized by a lower specific weight than said first metal, said faceplate mounted to said club head body at said receiving area, wherein said faceplate provides a faceplate weight savings over a faceplate constructed of said first metal;

means for securing said faceplate to said body at said receiving area without welding said faceplate to said body;

rear area weighting means for providing weight at a rear area of the club head behind a nominal ball impact point on said faceplate;

heel and toe area weighting means for providing weight at toe and heel areas of said club head; and wherein said rear, heel and toe weighting means redistribute said faceplate weight savings over said rear, heel and toe areas.

* * * * *